United States Patent [19]

Kukuck

[11] Patent Number: 4,737,294

[45] Date of Patent: Apr. 12, 1988

[54] MATRIX-RING MAGNETIC SEPARATOR

[75] Inventor: Karl-Heinz Kukuck, Ennigerloh, Fed. Rep. of Germany

[73] Assignee: Krupp Polysius AG, Beckum, Fed. Rep. of Germany

[21] Appl. No.: 885,842

[22] Filed: Jul. 16, 1986

[30] Foreign Application Priority Data

Aug. 14, 1985 [DE] Fed. Rep. of Germany ..... 3529186

[51] Int. Cl.[4] ..... B03C 1/00

[52] U.S. Cl. ..... 210/695; 209/214; 209/223.1; 209/225; 210/222; 210/391; 210/797

[58] Field of Search ..... 55/2, 100; 209/214, 209/223 R, 223 A, 225, 232, 223.1, 223.2; 210/222, 223, 391, 407, 409, 410, 695, 791, 797

[56] References Cited

U.S. PATENT DOCUMENTS 4,046,680 9/1977 Fritz ..... 209/223 A X
4,052,310 10/1977 Nolan ..... 210/222
4,191,591 3/1980 Bender et al. ..... 210/222 X
4,260,477 4/1981 Corrans ..... 209/223 R X

FOREIGN PATENT DOCUMENTS 1578396 11/1980 United Kingdom ..... 210/222

*Primary Examiner*—Peter Hruskoci
*Assistant Examiner*—W. Gary Jones
*Attorney, Agent, or Firm*—Learman & McCulloch

[57] ABSTRACT

The invention relates to a matrix ring magnetic separator the induction bodies of which are formed by sieve nettings which are arranged vertically and stacked behind one another in the direction of the magnetic field in such a way that the intersections of the wires of one sieve netting are located on the free field of the adjacent sieve netting resulting in the formation of sieve netting assemblies which are springy in themselves in the direction of the magnetic field. Even at very high field strength gradients such a magnetic separator is distinguished by good possibilities for cleaning and can also be produced economically.

19 Claims, 3 Drawing Sheets

MATRIX-RING MAGNETIC SEPARATOR

Figure 1:
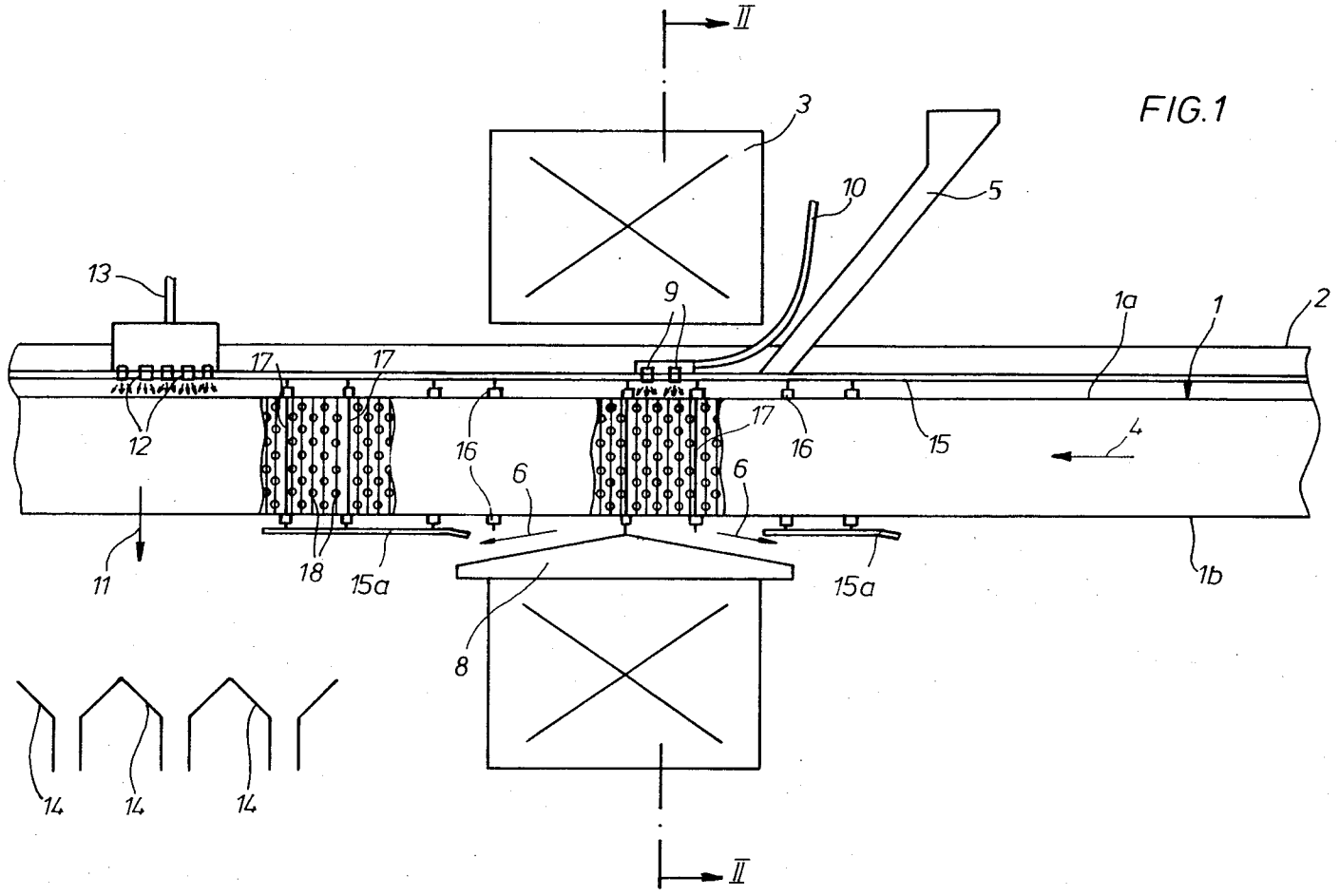

The invention relates to a matrix ring magnetic separator and a method of separating magnetically permeable and non-permeable materials.

BACKGROUND OF THE INVENTION

A matrix ring magnetic separator of the class to which the invention relates is disclosed in German Specification No. A-34 04 216. In this publication the induction bodies are formed by rods which are arranged radially and spaced from one another and below one another in a plurality of rows in such a way that the rods provided in adjacent rows are staggered with respect to one another. Sorting of slightly magnetic materials can be carried out with such a magnetic separator, and high throughput rates can be achieved and it is possible to clean the induction body easily.

The object of the invention is to provide a matrix ring magnetic separator of the class referred to in which the aforesaid advantages are retained and reliable cleaning off of the induction bodies is achieved even when the material is delivered dry and very high field strength gradients are used.

SUMMARY OF THE INVENTION

According to the invention the induction bodies are formed by sieve nettings which are arranged vertically and are stacked behind one another in the direction of the magnetic field in such a way that the intersections of the wires of one sieve netting are located on the free field of the adjacent sieve netting and in this way sieve netting assemblies are formed which are springy in themselves in the direction of the magnetic field.

In such a construction the sieve nettings can be untensioned in the region outside the magnetic field, so that the spaces between the wires of adjacent sieve nettings become larger. In this way large grains and foreign bodies which could lead to blockage of the matrix can be reliably removed from the enlarged spaces in the sieve netting matrix by means of a wet or dry rinsing agent.

The sieve netting induction bodies according to the invention can be used in either dry and wet operations. They have particular advantages in dry operation since here the danger of blockage of the matrix by grains and foreign bodies is practically excluded by the untensioning of the sieve netting assemblies outside the magnetic field and the easy cleaning which this facilitates.

According to an advantageous embodiment of the invention the cleaning off of the matrix can be further improved and at the same time the throughput capacity can be substantially increased if air nozzles through which jets of compressed air are blown into the matrix ring from above are arranged at least in the region of the magnetic field but advantageously also above the matrix ring and outside the magnetic field in the zone for separation of the magnetic components of the material. These jets of compressed air are an effective conveying aid particularly in the treatment of dry material charges, as they promote and accelerate the movement through the sieve netting matrix of the material charge which has limited flow capacity so that the throughput rate increases significantly and a desired cleaning of the adhering magnetic particles occurs. In the region outside the magnetic field the jets of compressed air ensure a quick and reliable separation of the magnetic particles from the sieve netting in the untensioned sieve netting matrix with the enlarged spaces.

THE DRAWINGS

Figure 2:
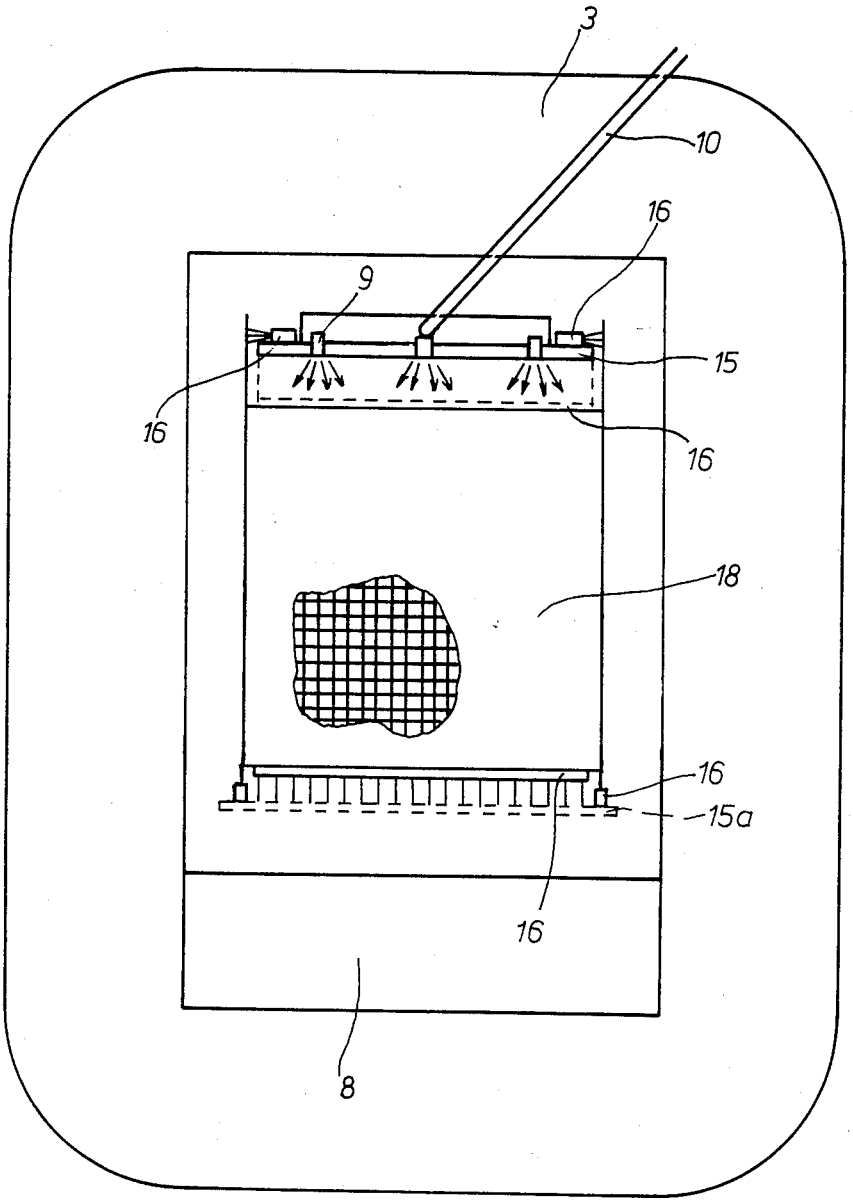
Figure 3:
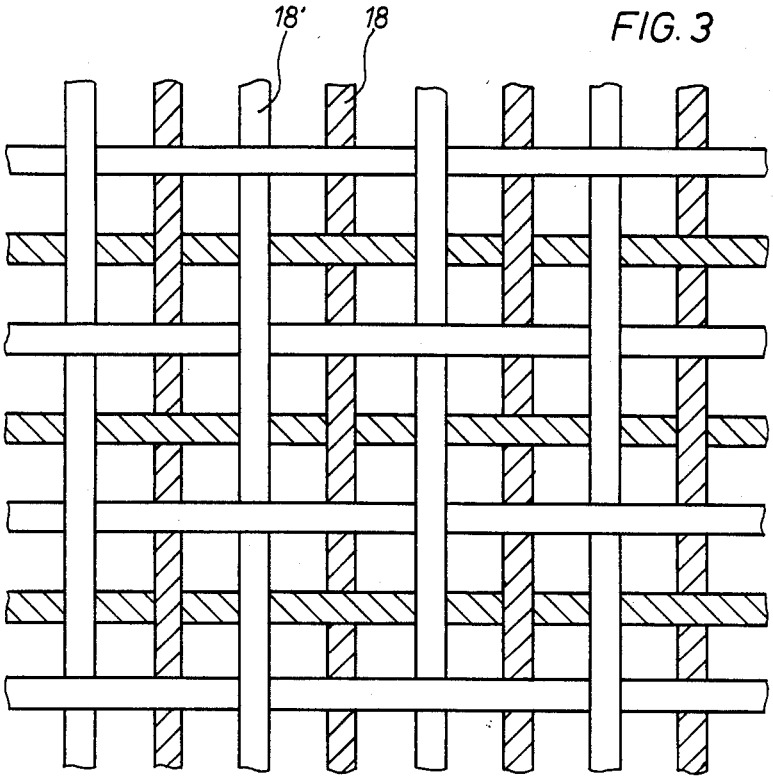

Advantageous embodiments of the invention are disclosed in greater detail in the following description and the accompanying drawings, wherein:

FIG. 1 shows a vertical section through a part of the matrix ring magnetic separator according to the invention, FIG. 2 shows a cross-section along the line II—II in FIG. 1, FIG. 3 shows a view of part of the sieve netting (on an enlarged scale, viewed in the direction of the magnetic field), FIG..4 shows a vertical section through a variant of the matrix ring (in the sectional view according to FIG. 1, but on an enlarged scale).

The illustrated matrix ring magnetic separator contains a matrix ring 1 which is rotatable about a vertical axis, is mounted in a housing 2 and is open on its upper face 1*a* and on its lower face 1*b*.

In a part of the matrix ring 1 a solenoid coil 3 produces a magnetic field which extends essentially in the peripheral direction (the direction thereof is characterised schematically by the arrow 4 in the matrix ring 1).

The dry material charge is delivered via a chute 5 onto the upper face 1*a* of the matrix ring 1. The non-magnetic material (arrow 6) coming downwards out of the matrix ring 1 in the region of the solenoid coil 3 is led off via an air conveyor trough 8 or a slide with the necessary inclination.

In the region of the solenoid coil 3 a plurality of air nozzles 9 are arranged above the matrix ring 1 and compressed air is delivered to them via an air pipe 10. The sharp jets of air produced by the air nozzles 9 pass downwards through the matrix ring 1 from above and form an effective conveying aid for the dry material charge which has a limited flow capability.

Air nozzles 12 to which compressed air is delivered via a pipe 13 are also arranged outside the region of the magnetic field produced by the solenoid coil 3, in the zone which serves for separation of the magnetic constituents of the material (arrow 11).

At least one fan, which is for example connected to the collecting funnel 14 which serves for removal of the magnetic product (arrow 11), is provided for extraction of the air coming out of the lower face 1*b* of the matrix ring 1.

In order to reduce the amount of infiltrated air drawn in covers 15 and 15*a* are arranged a small distance respectively above and below the matrix ring. Between these fixed covers 15, 15*a* and the rotatable matrix ring 1 sealing elements 16 such as brushes or rubber seals are provided. In this way the zone containing the air nozzles 9 in particular is sealed in the direction of the magnetic field and at right angles to the direction of the magnetic field against the escape and incursion of air by sealing elements 16. The negative pressure occurring in the region of these sealing elements 16 is very slight.

Partitions 17 which drive the matrix ring in the peripheral direction into individual open top and bottom chambers also contribute to the reduction in the quantity of infiltrated air which is drawn in. At the same time these partitions 17 form an effective guide for the jets of compressed air delivered through the air nozzles 9 or 12 and prevent lateral deflection of the flow.

The air nozzle 9 provided in the region of the magnetic field are distributed over a zone the circumferential length of which (in the direction of the magnetic field) and the radial breadth of which (at right angles to the magnetic field) correspond to the length and breadth of the chambers of the matrix ring 1 formed by the partitions 17.

The distance between the sealing elements 16 in the direction of the magnetic field is equal to the distance between successive partitions 17.

The air nozzles 12 provided outside the region of the magnetic field, on the other hand, are distributed over a zone the circumferential length of which (in the peripheral direction of the matrix ring) is greater than the corresponding length of the individual chambers of the matrix ring formed by the partitions 17 (the radial breadth of the zone over which the air nozzles 12 are distributed corresponds to the radial breadth of the individual chambers of the matrix ring).

In the chambers formed by the partitions 17 the matrix ring 1 contains induction bodies made from slightly magnetic material between which run substantially vertical channels for the material to be subjected to magnetic separation.

According to the invention the induction bodies are formed by sieve nettings 18 which are arranged vertically and are stacked one after another in the direction of the magnetic field (arrow 4) The intersecting vertical and horizontal wires of each netting form a mesh with the space between adjacent vertical and horizontal wires forming an open or free field. Adjacent nettings are arranged in such a way that the intersections of the wires of one sieve netting (e.g. 18 according to FIG. 3) are located on the free fields of the adjacent sieve netting 18'. This results to an extent in a "rod-on-space" arrangement (of FIG. 3). Because of their woven nature, the individual sieve nettings fit into each other well and together form a sieve netting assembly which is springy in itself in the direction of the magnetic field. Under the effect of the magnetic field these sieve netting assemblies are compressed, whilst outside the magnetic field they expand again. The resulting enlargement of the spaces in the sieve netting assembly together with the effect of the compressed air jets favours the cleaning off of permeable material retained by the nettings of the matrix in the region outside the magnetic field and thus produces an effective removal of the magnetic product (arrow 11).

Such a sieve netting matrix is distinguished by a very dense packing and high field strength gradients whilst at the same time being economical to produce. If during the movement of the matrix ring a particular chamber of the matrix ring leaves the region of the magnetic field of the solenoid coil 3, then the sieve netting assembly expands like a concertina and the spaces between the wires of adjacent sieve nettings can for example be doubled during the expansion.

From the constructional point of view, care should be taken to ensure that the sieve netting assemblies can contract and expand in the direction of the magnetic field within the chambers of the matrix ring 1 formed by the partitions 17 without free spaces occurriing during the contraction. This can be achieved for example by movable partitions or elastic intermediate layers. Also the sealing elements 16 prevent the incursion of the material charge into the spaces produced by contraction of the sleeve netting assembly.

The length of the sieve netting assembly 18 in the direction of the magnetic field is advantageously 80 to 120 mm.

During operation of the illustrated magnetic separator the speed of the jets of compressed air blown into the matrix ring from above can be between 5 and 20 m/s.

In order to reduce the air consumption it is possible within the scope of the invention for air to act periodically upon the air nozzles 9 when one chamber of the matrix ring 1 formed by two successive partitions 17 is located in the zone of the air nozzles. The next time air acts on the air nozzles 9 is when the matrix ring has moved further by the length of one chamber.

Figure 4:
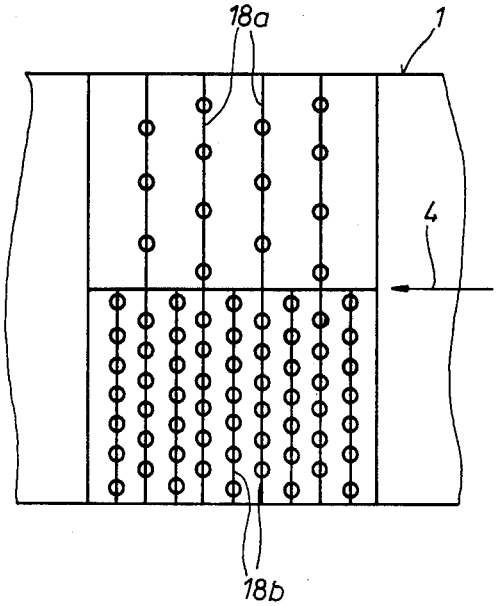

In the variant illustrated in FIG. 4 sieve nettings **18*a* are provided in the upper region of the matrix ring 1 with their wires a greater distance apart in the direction of the magnetic field (arrow 4) than the wires of the sieve nettings 18*b* arranged in the lower region of the matrix ring. The magnetic separation begins in the upper region of the matrix ring with a low field strength so that the more strongly magnetic particles are separated out in the sieve nettings 18*a***. In the lower region of the matrix, where the field strength is higher, the preliminary separation of the more strongly magnetic particles has already been completed. In this way a multi-stage magnetic separation without the formation of bridges is achieved with a material charge having widely varying susceptibility.

In order to prevent magnetic short-circuits, the vertical wires of the sieve nettings 18 are advantageously made from non-magnetic material whilst the horizontal wires on the other hand are made from slightly magnetic material. For reasons of cost, however, the vertical wires can also be made from slightly magnetic material. The assemblies of sieve nettings 18 can also be of self-supporting construction and thus do not require a separate housing, which significantly simplifies the production and maintenance.

I claim:

1. A method of separating magnetically permeable and non-magnetically permeable materials comprising rotating into, through, and out of a magnetic field a matrix ring having a plurality of open top and bottom chambers therein occupied by low permeability bodies in the form of stacked sieve nettings capable of attracting and retaining in said field magnetic materials; introducing said materials to said chambers as they approach said field; contracting said nettings as they pass through said magnetic field; passing air downwardly through said chambers as they pass through said field to discharge from such chambers the non-permeable materials; expanding said nettings as they pass out of said magnetic field; and passing air downwardly through said chambers when they move out of said field to discharge from such chambers the permeable material retained by said nettings.

2. A method according to claim 1 including passing air through said chambers in timed relation to their movement through said field.

3. In a matrix ring magnetic separator having:

a. a matrix ring rotatable about a vertical axis and being open at its upper and lower surfaces and containing a plurality of induction bodies between which extend substantially vertical channels for the reception of material to be separated, b. means for producing in said matrix ring a magnetic field extending essentially in a peripheral direction within a magnetic region of limited circumferential extent, c. means for delivering material to be separated to the upper face of said matrix ring in the magnetic region, d. means for forming a downward discharge zone below said magnetic region for receiving non-magnetic constituents of said material, and e. means forming a discharge zone outside said magnetic region for separating magnetic constituents of said material from the induction bodies, the improvement wherein:

f. the induction bodies comprise a plurality of sieve nettings arranged vertically and stacked circumferentially of said matrix ring one behind the other in the direction of said magnetic field in sieve netting assemblies, each of said sieve nettings being formed of vertical and horizontal wires which intersect one another and form a free field between the intersections of said wires, adjacent ones of said sieve nettings in each such assembly being arranged so that the intersections of the wires of one sieve netting are located on the free fields of the adjacent sieve nettings, said nettings being yieldably springy in the direction of said magnetic field, those sieve netting assemblies within said magnetic field being compressed for magnetic particle retention and those sieve netting assemblies outside said magnetic field being expanded for particle separation within said discharge zone.

4. A separator according to claim 3 wherein the vertical wires of each sieve netting are formed of non-magnetic material.

5. A separator according to claim 3 wherein each of said sieve nettings is self-supporting.

6. A separator according to claim 3 wherein the wires of said sieve nettings are formed of springy material.

7. A separator according to claim 3 wherein said ring has upper and lower sections and wherein the wires of said sieve nettings in the upper section are spaced farther apart than the wires in the lower section.

8. A separator according to claim 3 including air nozzles adjacent said ring in said magnetic field for directing air streams downwardly through said channels.

9. A separator according to claim 8 including additional air nozzles adjacent said ring outside said magnetic field for directing air streams downwardly through said channels.

10. A separator according to claim 3 including radially extending partitions between adjacent groups of nettings and forming individual chambers each of which contains a plurality of said nettings.

11. A separator according to claim 10 including air nozzles adjacent said ring in said magnetic field and distributed over a zone corresponding in circumferential length and radial width to the circumferential length and radial width of an individual one of said chambers.

12. A separator according to claim 11 including means sealing said zone circumferentially and radially to minimize the escape of air.

13. A separator according to claim 11 including means for connecting said nozzles to a source of compressed air.

14. A separator according to claim 10 wherein the circumferential length of said chambers is between about 80 and 120 mm.

15. A separator assembly according to claim 10 including air nozzles adjacent said ring outside said magnetic field and distributed over a zone having a circumferential length greater than the corresponding length of an individual one of said chambers and a radial breadth corresponding to the radial breadth of said individual chamber.

16. A separator according to claim 3 including means for passing gas downwardly through said matrix ring at a speed of between about 5 and 20 m/sec.

17. Apparatus according to claim 16 wherein said means for passing said gas downwardly through said matrix ring is operable at periodic intervals.

18. Apparatus according to claim 3 wherein selected ones of said sieve nettings having different mesh sizes and wherein coarser nettings serve as spacers and finer nettings produce magnetic field gradients.

19. In a matrix ring magnetic separator having:

a. a matrix ring rotatable about a vertical axis and being open at its upper and lower surfaces and containing a plurality of induction bodies between which extend substantially vertical channels for the reception of material to be separated, b. means for producing in said matrix ring a circumferential magnetic field, c. means for delivering material to be separated to the upper face of said matrix ring, d. means forming a downward discharge zone for non-magnetic constituents of said material, and e. means forming a discharge zone outside said magnetic field for separating magnetic constituents of said material from the induction bodies, the improvement wherein:

f. the induction bodies comprise a plurality of sieve nettings stacked circumferentially of said matrix ring, each of said sieve nettings being formed of vertical and horizontal wires which intersect one another and form a free field between the intersections of said wires, adjacent ones of said sieve nettings being arranged so that the intersections of the wires of one sieve netting are located on the free fields of the adjacent sieve nettings, the vertical wires of each sieve netting being formed of non-magnetic material.

* * * * *

UNITED STATES PATENT AND TRADEMARK OFFICE

CERTIFICATE OF CORRECTION

PATENT NO. : 4,737,294

DATED : April 12, 1988

INVENTOR(S) : Karl-Heinz Kukuck

It is certified that error appears in the above-identified patent and that said Letters Patent is hereby corrected as shown below:

Column 1, line 45, change "and" to -- or -- .

Column 2, line 62, change "drive" to -- divide -- .

Column 3, line 1, change "nozzle" to -- nozzles -- ; line 29, after "(arrow 4)" insert a period; line 37, change "of" (first occurrence) to -- cf. -- ; line 63, change "occurriing" to -- occurring -- ; line 68, change "sleeve" to -- sieve -- .

Column 5, line 6, cancel the word "for" .

Signed and Sealed this

Twentieth Day of September, 1988

*Attest:*

DONALD J. QUIGG

*Attesting Officer*

*Commissioner of Patents and Trademarks*